United States Patent [19]

Lewandowski

[11] 4,277,662

[45] Jul. 7, 1981

[54] SWITCH BLADE WITH WIPING CONTACT ACTION

[75] Inventor: Raymond Lewandowski, Waukegan, Ill.

[73] Assignee: Cherry Electrical Products Corp., Waukegan, Ill.

[21] Appl. No.: 155,946

[22] Filed: Jun. 3, 1980

[51] Int. Cl.[3] ..... H01H 1/60; H01H 1/20

[52] U.S. Cl. ..... 200/242; 200/243; 200/248

[58] Field of Search ..... 200/242, 240, 243, 286, 200/253, 241, 340, 249, 16 A, 16 B, 153 D, 248

[56] References Cited

U.S. PATENT DOCUMENTS

| | | | |
|---|---|---|---|
| 2,712,580 | 7/1955 | Nickell | 200/243 |
| 2,758,169 | 8/1956 | Weide | 200/243 |
| 3,855,558 | 12/1974 | Hayward | 200/243 |

*Primary Examiner*—Willis Little

*Attorney, Agent, or Firm*—Hume, Clement, Brinks, Willian & Olds, Ltd.

[57] ABSTRACT

A panel mounted switch consisting of two complementary side sections housing the switch components that include a plunger-type actuator carrying two movable switch blades and a series of fixed terminals. The switch blades being yieldably connected to the actuator whereby they are free to rock about their longitudinal axis upon engagement with certain of said fixed terminals, thereby achieving a self-cleaning, wiping switching contact.

10 Claims, 6 Drawing Figures

SWITCH BLADE WITH WIPING CONTACT ACTION

SUMMARY OF THE INVENTION

The object of this invention is to provide in a panel mounted switch a switch blade so constructed and arranged in relation to other switch structure that the contact heads carried by the blade will have a rocking-wiping action upon contact with stationary contact heads provided by fixed terminals.

The wiping action between contact heads of the blade and the stationary terminal is achieved by providing a plunger-type actuator movable through the switch housing. This plunger is provided with an open sided compartment in which the switch blade is carried and held against an inclined wall abutment which constitutes the bottom of the compartment by an expansion spring.

The switch blade is of a length so as to project beyond the sides of the plunger. The fixed terminals will provide contact arms extending in the path of the ends of the switch blade. By this arrangement, while the plunger is moved in one direction through the switch housing, the switch blades will be brought into engagement with the corresponding contact heads of the fixed terminal. As the switch blade lies in an inclined plane its contact heads will engage the fixed terminal in a likewise inclinded plane. Upon further movement of the actuator in the one direction the blade will be arrested against further movement due to its engagement with the fixed terminals. The bottom inclined wall of the compartment will move away from supporting the switch blade, while the increased tension upon the blade, by the now compressed expansion spring, will cause the free blade to rock into a parallel relation with respect to the fixed terminals. This latter movement causes a self-cleaning, wiping action between the circuit making contact heads of the switch blade and fixed terminals.

DESCRIPTION OF THE DRAWINGS

The invention will be best understood by reference to the accompanying drawings showing the preferred form of embodiment by which the stated object of the invention is achieved and in which.

GENERAL DESCRIPTION

The switch housing 10 is constructed from complementary side cases 11 and 12, one of which carries a full escutcheon plate 13.

Figure 3:
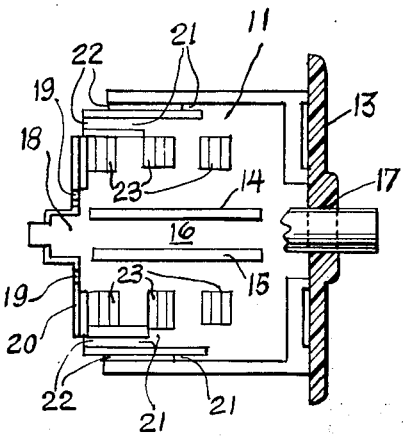
FIG. 3 is a side plan view of the interior of one of the switch side covers with parts removed.

As viewed in FIG. 3, the interior of the side case 11 provides two parallel abutments 14 and 15, forming therebetween a channel 16, which is in alignment with the opening 17 formed in the escutcheon plate 13. A compartment 18 is formed adjacent to one end of the channel 16 and it is defined at its sides by cuts 19 extending through the rear wall 20 of the side case 11.

A series of channels 21 are formed between ribs and terminate into cuts 22 formed in the rear wall 20. Also formed on the interior wall are a series of slotted retainers 23 located in pairs and aligned to either side of and parallel to the channel 16. The complementary side case 12 is identical in construction to that of case 11 and between the two are positioned the switch components.

Figure 1:
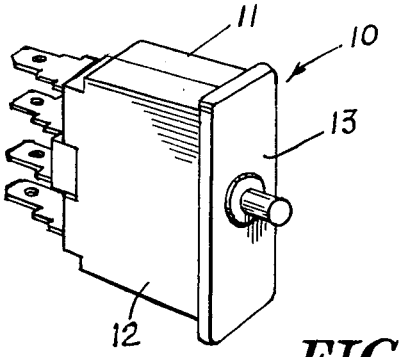
FIG. 1 is a perspective view of the switch structure.
Figure 2:
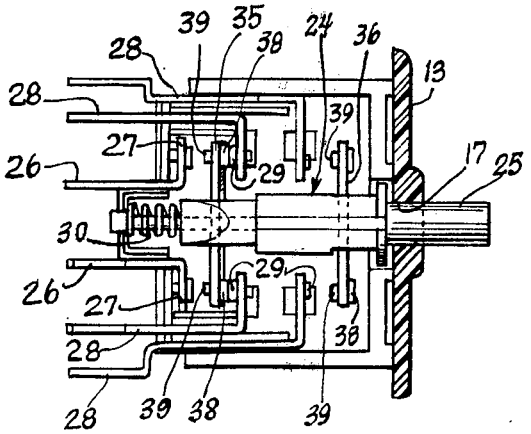
FIG. 2 is a side plan view of the switch construction with one of the side covers removed.

FIG. 2 illustrates the side case 11 with the switch components mounted therein. These components consist of a plungertype actuator 24, which provides at one end a button 25 that projects through the opening 17 formed in the escutcheon plate 13. Positioned within the cuts 19 are the legs 26 of a pair of fixed terminals. The terminals provide contact bearing portions 27, which are frictionally positioned in one pair of the slotted retainers 23. Adapted to be positioned within the grooves 21 are legs 28 of additional fixed terminals, which also provide contact bearing heads 29, which are held within the remaining pair of slotted retainers 23.

By this arrangement there is provided a set of three terminals to either side of the actuator 24, with the terminals providing a series of three contact bearing ends disposed in parallel relation with respect to each other.

Positioned in the compartment 18 is a coil spring 30 which will normally yieldably maintain the actuator 24 in its unactuated position shown in FIG. 2.

Figure 6:
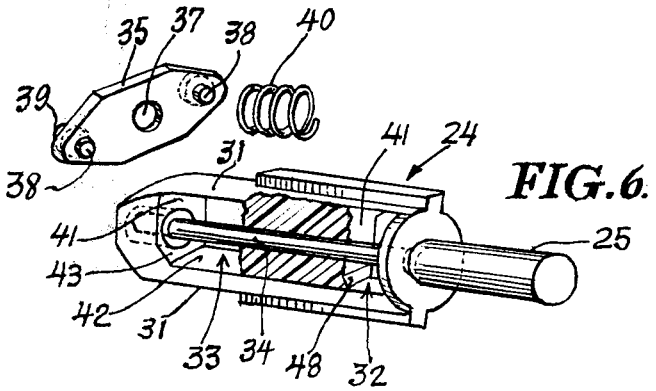

The plunger 24 consists of an elongated circular body 31 that provides two open sided compartments 32 and 33. Extending through the center of the compartments 32 and 33 is a circular stud 34. A pair of switch blades 35 and 36 are caused to be placed within the compartments 32 and 33 with the stud 34 extending freely through center openings 37 formed in each of the blades 35 and 36. The blades 35 and 36 have a length such that they extend beyond the side walls of the actuator 24 with the ends thereof providing contact heads 38 and 39 disposed on either side of each the blades. These contact heads 38 and 39 are adapted to be in, or moved into, engagement with corresponding contact heads on the fixed terminals 26 and 28. Also coiled about the stud 34 within the compartments 32 and 33 are coil expansion springs 40 (only one being shown in FIG. 6). The springs 40 will bear against the switch blades 35 and 36 and yieldably hold the same against the bottom walls 41 of the compartments 32 and 33.

Within the compartments 32 and 33 at the junction of the bottom walls 41 with one of the side walls 42, there is provided angular shoulders 43 and 48.

Figure 4:
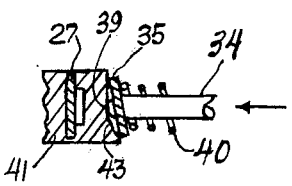
FIG. 4 is a fragmentary detailed sectional view of the switch blade and actuator in its normal or inactivated position.
Figure 5:
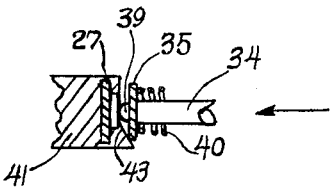
FIG. 5 is a fragmentary detailed sectional view similar to FIG. 4 showing the parts in a fully actuated switching position and, FIG. 6 is a perspective view with a portion in section showing the plunger-like actuator and wipeable switch blade in an exploded relation.

As shown in FIG. 4, the switch blade 35 in compartment 33 is caused to be yieldably held by the coil spring 40 in an inclined position against the shoulder 43.

As the actuator 24 is moved longitudinally within the switch housing, the switch blades 35 and 36 will move in the direction of the contact heads provided by the fixed terminals 26 and 28. During such movement and initial contact with the contact heads of the fixed terminals 26 and 28 the switch blades 35 amd 36 will be retained in their inclined position as shown in FIG. 4. As they engage the contact bearing end 27 and 29 of the fixed terminals 26 and 28, and as the plunger 24 is caused to be continuously moved through the switch housing 10, the inclined shoulders 43 and 48 will be moved away from the switch blades 35 and 36 and permit the same to roll upon the fixed contact heads under the tension of the coil springs 40 into a plane which is parallel to that of the fixed terminal heads. During this movement, the contacts 38 of the blades 35 and 36 will rock or wipe upon the surface of the fixed terminal heads in a self-cleaning movement. Upon return of the actuator 24, due to the release of the actuating force and the return expansion of the spring 30, blades 35 and 36 will again assume their relation with the shoulder 43 and thus be angularly disposed with respect to the longitudinal axis of the actuator 24.

While I have illustrated and described the preferred form of construction for carrying my invention into effect, this is capable of variation and modification without departing from the spirit of the invention. I therefore do not wish to be limited to the precise details of construction as set forth, but desire to avail myself of such variations and modifications as come within the scope of the appended claims.

Having thus described my invention what I claim as new and desire to protect by Letters Patent is:

1. An electrical switch having a housing for the switch components that include a plurality of fixed terminals wherein the improvement comprises (a) an actuator reciprocally movable through the switch housing, (b) an elongated switch blade carried by said actuator between at least two fixed terminals within the switch housing, (c) said switch blade being a length greater than the width of said actuator so as to extend beyond the opposite sides thereof, said switch blade having a contact on both sides of said switch blade, said contact on one side of said switch blade engaging a first one of said fixed terminals after said contact on the other side of said switch blade is disengaged from a second one of said fixed terminals, and said contact on the other side of said switch blade engaging the second of said fixed terminals after said contact on the one side of said switch blade is disengaged from the first of said fixed terminals as said actuator reciprocally moves within the switch housing, (b) means provided by said actuator for carrying said switch blade in an angular transverse relation to the longitudinal axis of said actuator, and (e) means yieldably mounting said switch blade to said actuator so as to permit said switch blade to tilt about its longitudinal axis whereby a self-cleaning, wiping action is provided by said contact on one side of said switch blade upon engaging one of said fixed terminals.

2. An electrical switch as defined by claim 1 wherein said means provided by said actuator for carrying said switch blade in an angular transverse relation to the long axis thereof comprises an inclined shoulder upon which rests one edge of said elongated switch blade with said switch blade held against said shoulder by said yieldably mounting means.

3. An electrical switch as defined by claim 1 wherein said means yieldably mouting said switch blade to said actuator comprises an expansion spring bearing upon one side of said switch blade interiorly of the contacts thereof.

4. An electrical switch as defined by claim 3 wherein said means provided by said actuator for carying said switch blade in an angular transverse relation to the long axis thereof comprises an inclined shoulder upon which rests one edge of said elongated switch blade with said blade held against said shoulder by said expansion spring.

5. an electrical switch as defined by claim 1 wherein said actuator provides an open sided compartment through which said elongated switch blade projects, and means within said compartment and in loose contact with said switch blade preventing longitudinal movement of said blade out of the open sided compartment.

6. An electrical switch as defined by claim 5 wherein said means provided by said actuator for carrying said switch blade in an angular transverse relation to the long axis thereof comprises an inclined shoulder upon which rests one edge of said elongated switch blade with said switch blade held against said shoulder by said yieldably mounting means.

7. An electrical switch as defined by claim 5 wherein said means yieldably mounting said switch blade to said actuator comprises an expansion spring bearing upon one side of said switch blade interiorly of the contacts thereof.

8. An electrical switch as defined by claim 7 wherein said means provided by said actuator for carrying said switch blade in an angular transverse relation to the long axis thereof comprises an inclined shoulder upon which rests one edge of said elongated switch blade with said blade held against said shoulder by said expansion spring.

9. An electrical switch as recited in Claim 1, wherein said switch further comprises an elongated switch blade carried by said actuator in and out of engagement with at least one fixed terminal, said switch blade being of a length greater than the width of said actuator so as to extend beyond the opposite sides thereof, said switch blade having contacts on at least one side of said switch blade, said contacts being adapted to engage the fixed terminals as said actuator reciptocally moves within the switch housing.

10. An electric switch comprising:

(a) a housing having an opening;

(b) a plurality of fixed terminals at least partially contained within said housing;

(c) a plunger within said housing having a portion thereof extending through said opening and at least two open sided compartments;

(d) a switch blade carried in said first compartment and retained by a stud extending across said first compartment parallel to the longitudinal axis of said plunger, said switch blade being of a length greater than the width of said plunger so as to extend beyond the opposite sides of said plunger, said switch blade having contacts on both sides of said switch blade, said contacts adapted to engage said fixed terminals;

(e) means for engaging said contacts on one side of said switch blade with said fixed terminals, breaking said engagement, and engaging said contacts on the opposite side of said switch blade with said fixed terminals;

(f) means for rocking said contacts when said contacts engage one of said fixed terminals, said rocking means including said first compartment having a first wall upon which rests one edge of said switch blade, a spring disposed between the side of said switch blade and a second wall of said first compartment urging said switch blade against said first wall; and, (g) a second switch blade carried in said second compartment and retained by said stud extending across said second compartment parallel to the longitudinal axis of said plunger, said second switch blade being of a length greater than the width of said plunger so as to extend beyond the opposite sides of said plunger, said second switch blade having a contact on at least one side of said switch blade, said contact adapted to engage one of said fixed terminals, said engaging means further including said contact of said second switch blade engaging one of said fixed terminals and breaking said engagement, said rocking means further including said contact of said second switch blade rocking as said contact engages one of said fixed terminals.

* * * * *

UNITED STATES PATENT AND TRADEMARK OFFICE

CERTIFICATE OF CORRECTION

PATENT NO. : 4,277,662

DATED : July 7, 1981

INVENTOR(S) : Raymond Lewandowski

It is certified that error appears in the above—identified patent and that said Letters Patent is hereby corrected as shown below:

In column 1, line 29, delete "inclinded" and insert therefor --inclined--.

In column 2, line 14, delete "plungertype" and insert therefor --plunger-type--.

In column 2, line 43, insert --of-- immediately after "each".

In column 3, Line 45, delete "(b)" and insert therefor --(d)--.

In column 3, line 62, delete "mouting" and insert therefor --mounting--.

In column 4, line 39, delete "reciptocally" and insert therefor --reciprocally--.

Signed and Sealed this

*Tenth* Day of *November 1981*

[SEAL]

*Attest:*

GERALD J. MOSSINGHOFF

*Attesting Officer*

*Commissioner of Patents and Trademarks*